United States Patent [19]

Mayer et al.

[11] Patent Number: 4,918,934

[45] Date of Patent: Apr. 24, 1990

[54] METHOD FOR COOLING ROOMS

[76] Inventors: Georg Mayer, Innsbrucker Str. 37, 1 Berlin 62; Friedrich H. Schmidt, Kaule 34, 5060 Bergisch Gladbach 1; Friedrich H. Schmidt, Kaule 34, 5060 Bergisch Gladbach 1, all of Fed. Rep. of Germany

[21] Appl. No.: 247,283

[22] Filed: Sep. 21, 1988

[30] Foreign Application Priority Data

Sep. 22, 1987 [DE] Fed. Rep. of Germany ..... 3731800
Sep. 29, 1987 [DE] Fed. Rep. of Germany ..... 3732792
Oct. 5, 1987 [DE] Fed. Rep. of Germany ..... 3733671

[51] Int. Cl.[5] ..... F25D 17/04

[52] U.S. Cl. ..... 62/89; 62/407; 98/31.6; 165/128

[58] Field of Search ..... 165/128, 129; 98/31.5, 98/31.6; 62/89, 407, 440

[56] References Cited

U.S. PATENT DOCUMENTS 1,525,845 2/1925 Williams ..... 62/407 X
1,657,447 1/1928 Lindseth ..... 98/31.6 X
2,251,725 8/1941 Warren ..... 98/31.6 X
2,300,303 10/1942 Morrison ..... 62/440 X
2,875,679 3/1959 Humbert ..... 98/31.5
3,530,683 9/1970 Watkins ..... 62/89
4,053,732 10/1977 Carter ..... 98/31.6 X
4,185,545 1/1980 Rusth et al. ..... 98/31.5
4,403,732 9/1983 Primich ..... 98/31.6 X
4,775,001 10/1988 Ward et al. ..... 98/31.5 X

*Primary Examiner*—William E. Tapolcai
*Attorney, Agent, or Firm*—Browdy and Neimark

[57] ABSTRACT

In a method for cooling rooms, the energy exchange between warm room air and cold air takes place through inherent convection of the air by means of a drop shaft arranged in the room, which has cooling surfaces in its upper part, at which the in-coming warm room air cools, and flows downwards owing to the specific weight difference. The cooled air leaves the drop shaft at the lower end in a laminar flow and then spreads in the room in an unbroken cool layer. The air leaving the drop shaft can also be deflected into a hollow floor. It is possible to use a fan to add to the cooled air current moved by gravity disturbing air, which then occasions turbulence.

3 Claims, 1 Drawing Sheet

FIG. 1
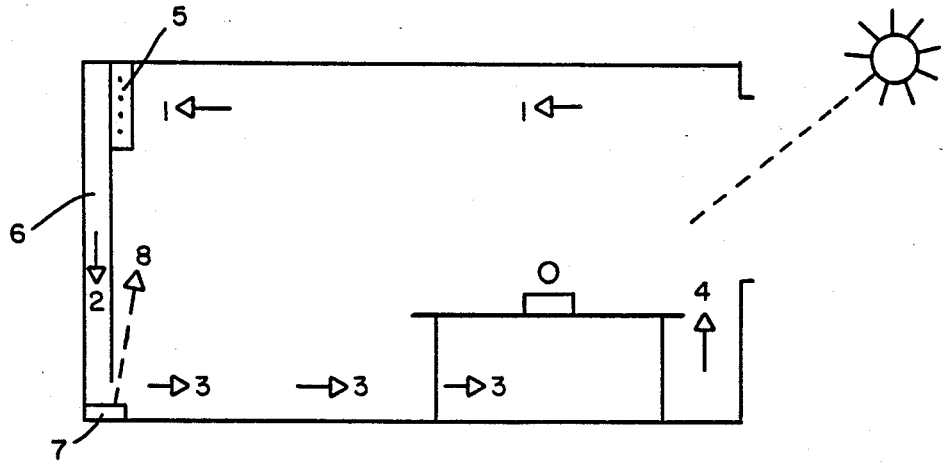
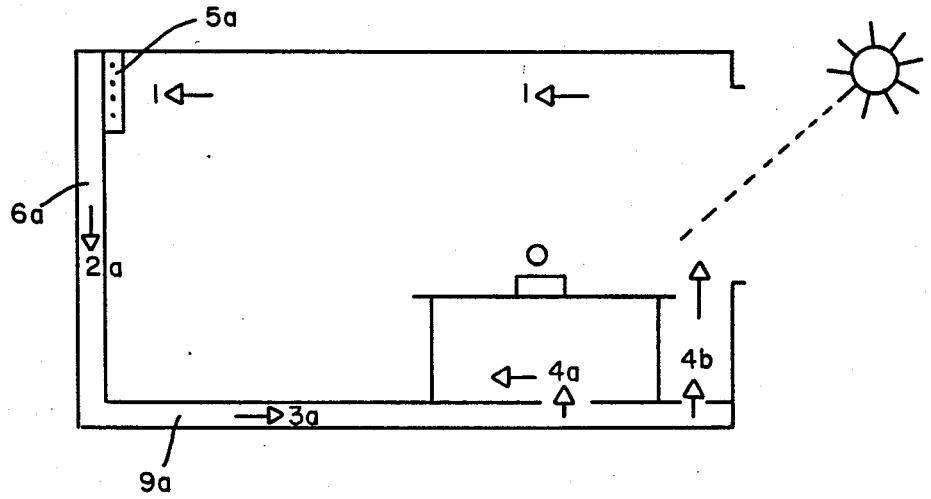
FIG. 2

METHOD FOR COOLING ROOMS

FIELD OF THE INVENTION

The invention relates to a method of dissipating thermal loads of a room.

BACKGROUND OF THE INVENTION

Various methods have been developed for this purpose, most of which are based on the introduction into the room of air which has a lower temperature than the air present in the room, and is therefore capable of extracting thermal energy from the room, and thus of reducing the room temperature. The basis of these known methods is that the air is conveyed mechanically, and fed to the room at various locations, namely either from above or from the side wall or also through the floor. With these known methods, a substantial portion of the entire energy consumption is made up of a mechanical conveyance of the air by fans.

As an alternative to the above mentioned room cooling by air exchange, it has also been proposed to extract heat from the room by cooling at surfaces located in the room, i.e. by means of heat exchange by radiation and inherent convection, but this fails in most cases because suitable surfaces are not available in the room or because in practice only a very slight temperature difference is possible.

SUMMARY OF THE INVENTION

According to the invention, however, the energy exchange takes place through the inherent convection of the air. To this end, it is proposed to use a drop shaft in the room, which has cooling surfaces in its upper part, at which the warm air cools, and as a consequence of its specific weight difference to the room flows downwards through the drop shaft. It is preferably provided in this connection that the cooled air moved downwards in the drop shaft by gravity emerges in laminar flow from the lower end of the drop shaft, and then spreads in the room, covering the floor in an unbroken cool layer, as far as the walls containing the room. The abovementioned cooling surfaces can then be cooled, for example, with water or refrigerant.

BRIEF DESCRIPTION OF THE DRAWINGS

FIG. 1 depicts a room where thermal loads are generated by the sun and a person sitting in a room in which warm air comes in contact with cooling surfaces in the upper part of a drop shaft, becomes cool and flows downwards in the drop shaft as a consequence of the specific weight difference and moves in a laminar flow from the lower end of the drop shaft and spreads into the room along the floor.

FIG. 2 depicts a room similar to that in FIG. 1 wherein an locations near the floor, one or more air currents generated by a fan are fed as disturbing air to the cooled air moved downwards by gravity in the drop shaft, to provide a fine turbulence of the cooled air.

DETAILED DESCRIPTION OF THE INVENTION

Within certain limits, the method according to the invention produces a self-regulation, since, as the room cools, the circulating force is automatically reduced by decrease of the specific weight difference, and less cooled air therefore flows into the room.

The cooling surfaces 5 can be formed from smooth pipes, ribbed pipes, heat exchangers with ribs and plates, or the like, which are known per se.

Apart from the self-actuating regulation, regulation can take place for the purpose of increasing comfort via the temperature of the medium cooling the cooling surfaces, or by diverting the current of cooling medium. If the cooling power is to be decreased, it can be provided that the cooling medium flows through the heat exchanger lower down.

As can be seen from FIG. 1, air emerging 3 from the lower end of the drop shaft 6 wells into the room, as it were, and displaces the warmer air contained in the room in a layer near the floor. Such a source ventilation has the advantage that no energy is consumed by fans. As a consequence of the stratification which forms, a cushion of greater or lesser height formed from colder air forms under the warmer air present in the room. In fact, in the course of time a certain pulsed exchange takes place at the boundary between the colder layer and the overlying warmer layer, so that it is then possible for the layers to be separated no longer by a sharp boundary plane, but by a more or less thick transition layer. It is a consequence of such a source ventilation that a lower temperature prevails near the floor, where the feet of persons staying in the room are located, than at the height at which the heads of the persons are located. Depending on whether the persons are predominantly sitting or standing or moving around, their heads are located at a height of between 1.50 and 1.80 m. To the extent, now, that the difference in temperature between the floor and head height does not exceed a certain limiting value, approximately 2° K. to 3° K., this will be perceived by the persons as uncomfortable, although with this type of air cooling by source ventilation the temperature comfort is already perceived as substantially greater than with a conventional cooling of the rooms. However, with cooling by source ventilation, the extremely low, or entirely absent air flow rate, which lies here far below the empirically established limiting values, is perceived as especially pleasant.

At all warmer surfaces of the room, e.g. at locations at which persons, machines or lighting fixtures are located, as well as on surfaces which have received an enhanced temperature owing to insulation, cool room air 4 flows upwards from the lower cool layer, so that the abovementioned temperature difference is once again somewhat decreased. Nevertheless, even with a room cooling by source ventilation there remains a residual temperature gradient in the upwards direction, as is necessarily caused by the slow displacement of the room air by the cooler air welling in below.

In further development of the invention it is now provided that at arbitrary locations near the floor one or more than one air currents generated by a fan are fed as disturbing air 8 to the cooled air moved downwrads by gravity. Within a certain layer near the floor, this disturbing air then produces a fine turbulence of the cool air located in this layer after welling in, and thus a reduction of the temperature difference. Preferably, the ratio of the volume flows of disturbing air to source air is chosen to be so large that owing to the disturbing air the difference between the temperature at a fixed height above the floor and this temperature directly at the floor is reduced to a predetermined limiting value. In order to create a pleasant climate for persons staying in the room, it is expedient to take the mean, or also the maximum height of the heads of the persons as fixed height.

In so far as it is a question of sensitive equipment or appliances or standards of measurement, the height at which these appliances or the like are located will hold as fixed height.

The particular advantages of the method of achieving the object according to the invention may be seen in the cooling of rooms in which persons stay, because the particular advantage of source ventilation, namely a low to vanishingly low air flow rate, is thereby retained, and at the same time an evenness of temperature is achieved in a lower region of the room, such as could not be conceived before.

A particular advantage of the source ventilation achieved by gravity lies in that no energy is required for transporting the air.

Even if, in accordance with the further development of the invention, disturbing air is to be used, only a slight amount of energy is required for this relatively slight current of disturbing air. According to a further development of the inventive idea, this energy can be further substantially decreased by switching off the disturbing air in the periods in which no persons stay in the room, and accepting a certain formation of stratification during these periods. For example, the fans generating the disturbing air can be switched off at nighttime, and switched on again in the morning only if it is thought that persons will enter. However, it is also possible to employ sensors of whatever type, which react to the presence of persons, and cause them to switch on the fans for the disturbing air. However, such equipment features do not fall within the framework of the present invention.

At what locations and in which direction the current of disturbing air is fed, is not especially critical. All that is important is that a turbulence is achieved owing to the disturbing air. In this way, the relatively low height of the layer of colder air lying at the floor is increased, and its temperature is also correspondingly enhanced.

Injection nozzles, 7 which deliver the disturbing air at a high flow rate, can expediently be used to feed the disturbing air. These injection nozzles can be arranged at arbitrary locations, provided only that they feed the disturbing air to the cooled source air in the desired way.

As disturbing air, one can employ either warm air from the upper part of the room, there then being an enhanced mixing effect when this warmer disturbing air encounters the cooled air.

However, as disturbing air one can also tap cold air from the cooled air moved by gravity, the cool air current, or the layer height formed therefrom, then being increased.

Finally, one can also employ fresh air introduced from outside as disturbing air, there then taking place a humidity regulation or also a renewal of air.

A decision as to how the fans or the injection nozzles are to be powered must be taken in the individual case after weighing up the advantages and disadvantages.

In further development of the method according to the invention it is provided that the air cooled and moved downwards as shown in FIG. 2 in the drop shaft by gravity is deflected into a hollow floor 9*a* and emerges from the latter into openings 4*a*, 4*b* already provided, preferably under or next to the thermal loads located in the room.

It is achieved by this deflection that a special cooling can take place at any desired location of the floor. The special advantages of this further development of the method are seen in that, if required, the rooms can be precooled in summer in the absense of persons, without the operation of the fan already mentioned. To the extent that a higher cooling power is then required in the room, it is possible in further development of the method to use fans, which here increase transport through the hollow floor of the cooled air delivered by the drop shaft.

Here, too, the fans, or the injection nozzles employed, produce in the cold air flowing through the hollow floor a turbulence, which causes a better heat exchange at the surrounding surfaces. Here, too, disturbing air fed in can cause within a certain layer near the floor a fine turbulence of the cooling air which has welled in, and thus a decrease in the temperature difference.

It may be remarked once again in summary that a special advantage of the method according to the invention lies in the fact that no energy is required for transporting the air. Even if, for the reasons mentioned above, disturbing air is fed in additionally through a fan, only a small amount of energy is required for this purpose. This energy, too, is also substantially further decreased by turning off the fans in the periods in which the disturbing air is not required.

Just like the disturbing air, the air moved by gravity can be cleaned with air filters in a way known per se. Since it is not possible to use any air filters with a marked air resistance for the air moved downwards by gravity, the known electrostatic air filters with absorbent carbon are especially well-suited in this connection. However, these filters are not an object of the invention.

We claim:

1. A method for dissipating thermal loads of a room using an extremely low air flow rate comprising, providing a drop shaft in a room allowing warm air to contact said drop shaft which has cooling surfaces in its upper part to cool and move air warm air entering the drop shaft at its upper end is cooled and is moved downwards by gravity to leave the drop shaft at its lower end, deflecting air leaving the drop shaft at its lower end into a hollow floor and passing said air from the hollow floor through predetermined openings, under or next to the thermal loads located in the room.

2. A method for dissipating thermal loads of a room using an extremely low air flow rate comprising, providing a drop shaft in a room, allowing warm air to contact said drop shaft which has cooling surfaces in its upper part to cool and move air, is moved downwards by gravity to leave the drop shaft at its lower end, and feeding one or more air currents generated by a fan at arbitrary locations as disturbing air to the air emerging from the drop shaft.

3. A method according to claim 2, wherein disturbing air is fed only when persons are present in the room.

* * * * *